United States Patent [19]

Bershas

[11] 4,425,399

[45] Jan. 10, 1984

[54] MATS FOR ASPHALT UNDERLAY

[75] Inventor: James P. Bershas, Newark, Ohio

[73] Assignee: Owens-Corning Fiberglas Corporation, Toledo, Ohio

[21] Appl. No.: 391,208

[22] Filed: Jun. 23, 1982

Related U.S. Application Data

[62] Division of Ser. No. 274,969, Jun. 18, 1981, Pat. No. 4,359,546.

[51] Int. Cl.[3] ..... D04H 1/58; B32B 27/02

[52] U.S. Cl. ..... 428/288; 428/392; 428/395

[58] Field of Search ..... 427/407.2, 407.3, 407.1; 428/268, 288, 392, 395, 396, 378

[56] References Cited

U.S. PATENT DOCUMENTS

| | | | |
|---|---|---|---|
| 3,082,183 | 3/1963 | Boyd | 260/29.4 UA |
| 3,256,234 | 6/1966 | Miller | 260/29.4 UA |
| 3,925,287 | 12/1975 | Andersen | 260/29.4 UA |
| 4,094,846 | 6/1978 | Delapp | 260/29.4 UA |
| 4,258,098 | 3/1981 | Bondoc et al. | 260/29.4 UA |

*Primary Examiner*—Theodore E. Pertilla

*Attorney, Agent, or Firm*—Ronald C. Hudgens; Greg Dziegielewski; Philip R. Cloutier

[57] ABSTRACT

A woven or non-woven mat comprising natural or synthetic fibers bonded together with the residue formed by removing water from an aqueous composition comprising a thermoplastic emulsion and a melamine formaldehyde resin forms an underlay for asphalt paving for road surfaces.

4 Claims, No Drawings

MATS FOR ASPHALT UNDERLAY

This application is a division of application Ser. No. 274,969, filed June 18, 1981, now U.S. Pat. No. 4,359,546.

BACKGROUND OF THE INVENTION

This invention relates to mats for asphalt underlay as a base for asphaltic road surfaces.

In one of its more specific aspects, this invention pertains to a composition mat and binder suitable for use as an underlay for asphalt paving for road surfaces.

The use of non-woven mats as an underlay for asphalt paving is well known. Generally, such mats are employed by first applying to the highway to be repaired an asphalt composition over which the mat is laid and to which the mat adheres. A tack coat may, or may not, be applied over the mat. In either instance, an asphalt mix is then deposited over the mat and the surface is leveled and rolled. One of the mats presently so employed is comprised of non-woven, needle-punched polypropylene.

The most important property such mats much possess is tensile strength. In addition, such mats should possess low porosity to prevent excess asphalt for strike-through, should exhibit high flexibility and elongation and should not cause skin irritation to those handling the mats.

STATEMENT OF THE INVENTION

There has now been developed a mat which possesses such properties. This mat comprises a woven or non-woven composite having on its surface a residue formed by removing water from an aqueous composition comprising a thermoplastic emulsion and a melamine formaldehyde resin.

In a preferred embodiment, the thermoplastic emulsion will be selected from the group consisting of carboxylated styrene-butadiene latexes, vinyl chloride-ethylene acrylamide terpolymers, styrene acrylics and vinyl acrylics, or mixtures thereof, a carboxylated styrene-butadiene polymer in combination with an ethylene-vinyl chloride-acrylamide being the most preferred combination of thermoplastics.

The mat of this invention has been found to be highly satisfactory in the laying of composition road surfaces in which the road paving composition is superimposed on the mat.

DESCRIPTION OF THE INVENTION

If an acrylic polymer is employed, it will preferably be in the form of an aqueous acrylic emulsion such as E-1653, available from Rohm and Haas, Philadelphia, PA. This material is about 47.5 weight percent solids, is contained in an anionic surfactant system and has a 13° C. film forming temperature.

If a carboxylated styrene-butadiene latex is employed, it will preferably be in the form of an aqueous emulsion such as Dow Latex 485, available from Dow Chemical Co., Midland, MI. This material is 46 weight percent solids and has a film forming temperature of about 25° C.

If an ethylene vinyl chloride is used, it will preferably be in the form of an aqueous emulsion of vinyl chloride-ethylene-acrylamide terpolymer such as Airflex 4514, available from Air Products and Chemicals, Inc., Philadelphia, PA. This material is 48 weight percent solids.

Any suitable melamine-formaldehyde resin can be employed. One particularly suitable melamine-formaldehyde resin is Diaron 27-611, available from Reichhold Chemicals Inc., White Plains, NY. This material is a methylated melamine formaldehyde provided as a water soluble composite containing 60 weight percent solids.

Another suitable melamine-formaldehyde resin is Cymel 303, available from American Cyanamid, Bound Brook, NJ. This material is hexamethoxymethylmelamine having a specific gravity (25° C.) of 1.2, a refractive index of 1.515–1.520 and a viscosity (Gardner-Holdt, 25° C.) of $X$-$Z_2$.

The binder formulation will comprise, on a parts by weight-solids basis, from about 91 to about 97 weight percent aqueous thermoplastic emulsion, from about 3 to about 7 weight percent of the melamine formaldehyde resin and up to about 2 weight percent of a water-soluble ammonium salt catalyst, such as ammonium sulfate. It can also contain minor amounts of ammonium hydroxide as a pH modifier, and defoamers commonly used in the art.

In the preferred embodiment of the invention, the binder will be comprised of about 94 weight percent of the thermoplastic emulsion, about 5 weight percent of the melamine formaldehyde resin and about 1 weight percent of the catalyst.

In the preferred embodiment of the invention in terms of commercially available materials, the binder will be comprised of carboxylated styrene-butadiene latex (Dow's Latex 485) in an amount of from about 36.4 to about 58.2 weight percent, an ethylene-vinyl chloride-acrylamide (Air Products Airflex 4514) in an amount of from about 36.4 to about 58.2 weight percent, a methylated melamine formaldehyde (Reichhold's Diaron 27-611) in an amount of from about 3 to about 7 weight percent and up to about 2 weight percent ammonium sulfate as catalyst.

The binder of this invention can be applied to any mat of any material, however formed. For example, it can be applied to sized glass fibers, mineral fibers, synthetic fibers or natural fibers, or mixtures thereof.

For the preferred underlay mat of this invention, it will be applied to a mixture of glass fibers and synthetic polymeric fibers, such as polyester fibers.

Any suitable size and quantity of glass fibers will be employed.

Preferably, the sized glass fibers will be 6.4 to 15.7 microns in diameter, 6.35–50.8 mm in length and will comprise about 60 to about 100 weight percent of the fibers of the mat.

The polyester fibers will be 6 to 15 denier, about 25 mm to about 40 mm in length and will comprise up to about 40 weight percent of the fibers of the mat.

In the preferred embodiment, the glass fibers will be 19.05 mm long by about 10.9 microns and will comprise about 60 to about 80 weight percent of the mat. The polyester fibers will be 1½ inches long, 15 denier and will comprise about 20 to about 40 weight percent of the fibers of the mat.

The mats of this invention can be made in any manner. However, they are preferably made by dispersing a well-mixed quantity of the selected fibers in an aqueous medium containing a dispersant such as a polyalkoxylated alkylamine wetting agent and withdrawing the fibers as a wet-laid mat from the aqueous medium. The entire process is well known in the art.

The binder of this invention can be applied to the dry mat in any suitable manner, all of which methods are known in the art. For example, the binder can be sprayed on or, preferably, the binder can be poured over the mat and the excess binder removed under vacuum. In the final cured mat, the binder will comprise about 20 to about 35 weight percent of the mat, preferably about 30 weight percent.

The binder on the mat can be cured in any suitable manner. Preferably, it will be passed through an oven at a temperature of about 500° to about 650° F. for a time sufficient to cross-link the components of the binder and to produce a non-tacky mat.

The following example sets forth the procedure for producing a preferred binder composition of this invention.

EXAMPLE I

One thousand pounds of water were added to a mix tank and with slow agitation, 2983 pounds of carboxylated styrene-butadiene rubber latex and 2567 pounds of ethylene-vinyl chloride-acrylamide were sequentially introduced thereinto.

One hundred pounds of a water diluted anti-foam agent were introduced into the tank and the composite was stirred for 16 hours. Thereafter, 230 pounds of methylated melamine formaldehyde were introduced into the main mix tank, followed by 1000 pounds of water.

While continuing to stir, sufficient ammonium hydroxide was added to adjust the pH to 6.5±0.2. and 267.4 pounds of 10 weight percent ammonium sulfate were sequentially added to the mix tank. 99.1 pounds of the antifoam agent were then added to the mix tank and sufficient water was added to the main mix tank to bring the total weight of the aqueous binder to 9000 pounds. Mixing was continued for a time sufficient to attain uniformity.

The aqueous binder had a pH of 6.6, a solids content of 32 weight percent and a viscosity of 8.5 cps 96° F.

It will be evident from the foregoing that various modifications can be made to this invention. Such, however, are within the scope of the invention.

I claim:

1. A composition of matter comprising at least one fiber selected from the group consisting of glass fibers, mineral fibers, synthetic resin fibers and natural fibers and the residue formed by removing water from an aqueous composition consisting essentially of a thermoplastic emulsion of carboxylated styrene butadiene latexes, at least one thermoplastic emulsion selected from the group consisting of emulsions of vinyl chloride-ethylene acrylamide terpolymers, styrene acrylics and vinyl acrylics and mixtures thereof and a melamine formaldehyde resin selected from the group consisting of methylated melamine formaldehyde resin and hexamethoxymethyl melamine, and an ammonium salt catalyst.

2. The composition of claim 1 comprising a mixture of glass fibers and polyester fibers.

3. The composition of claim 1 in which said fibers comprise a mat comprised of about 60 to about 80 weight percent glass fibers and about 20 to about 40 weight percent polyester fibers.

4. The composition of claim 1 in which said residue comprises about 25 to about 35 weight percent of said composition.

* * * * *

UNITED STATES PATENT AND TRADEMARK OFFICE

CERTIFICATE OF CORRECTION

PATENT NO. : 4,425,399

DATED : January 10, 1984

INVENTOR(S) : JAMES P. BERSHAS

It is certified that error appears in the above-identified patent and that said Letters Patent is hereby corrected as shown below:

Column 1, line 24, the word much should read: must

Column 3, line 31, the period after 6.5±0.2 should be a comma

Signed and Sealed this

*Twenty-third* Day of *October 1984*

[SEAL]

*Attest:*

GERALD J. MOSSINGHOFF

*Attesting Officer*

*Commissioner of Patents and Trademarks*